US005609323A

United States Patent [19]

Lee

[11] Patent Number: 5,609,323

[45] Date of Patent: Mar. 11, 1997

[54] MODULAR WALL FORM ASSEMBLY

[76] Inventor: Kou-An Lee, No. 851, Chung-Shan Rd., Nan-Shing Tsun, Kui-Jen Hsiang, Tainan Hsien, Taiwan

[21] Appl. No.: 516,971

[22] Filed: Aug. 18, 1995

[51] Int. Cl.[6] ..... E04G 11/08

[52] U.S. Cl. ..... 249/193; 249/47; 249/192; 249/195; 249/196

[58] Field of Search ..... 249/47, 192, 193, 249/195, 196

[56] References Cited

U.S. PATENT DOCUMENTS

| | | | |
|---|---|---|---|
| 1,212,654 | 1/1917 | McKay | 249/192 |
| 1,300,436 | 4/1919 | McKay | 249/192 |
| 3,931,951 | 1/1976 | Fougea | 249/158 |
| 4,901,497 | 2/1990 | Lee | 249/47 |
| 4,957,272 | 9/1990 | Lee | 249/47 |
| 5,552,103 | 9/1996 | Lee | 249/47 |

*Primary Examiner*—Thomas R. Weber
*Attorney, Agent, or Firm*—Merchant, Gould, Smith, Edell, Welter & Schmidt, P.A.

[57] ABSTRACT

A modular wall form assembly includes two upright wall form panels, a bridging plate interposed removably between the wall form panels, and a plurality of coupling devices for connecting securely the wall form panels and the bridging plate. Each of the coupling devices includes at least three horizontally aligned coupling seats mounted respectively on the rear sides of the wall form panels and the bridging plate, and a T-shaped coupling lever. Each of the coupling seats is formed with a rectangular hole and a notch that is located on a longer side of the rectangular hole and that extends to the rectangular hole. The notch has a width shorter than the length of the longer side of the rectangular hole. The coupling lever has a handle that is transversely aligned with respect to a coupling portion. The coupling portion has a cross section that corresponds in size with the rectangular holes of the coupling seats. The wall form panels and the bridging plate are interconnected by inserting the coupling portion into the rectangular holes of the coupling seats.

4 Claims, 7 Drawing Sheets

MODULAR WALL FORM ASSEMBLY

BACKGROUND OF THE INVENTION

1. Field of the Invention

This invention relates to a modular wall form assembly, more particularly to a modular wall form assembly which can be easily removed after a concrete wall has been formed.

2. Description of the Related Art

A wall form assembly is used to define a pouring space into which concrete is poured and cast to form a concrete wall. Presently, wall form assemblies are modular in construction and are made of steel, instead of wood, to achieve better product quality and efficiency and increased economic benefits.

Referring to FIG. 1, inner and outer wall form assemblies 10, 11 confine a pouring space for forming a concrete surrounding wall 12 therein. After the wall 12 has been formed, the outer wall form assemblies 11 can be disassembled and hoisted away from the wall 12 with the use of a machine (not shown). However, the inner wall form assemblies 10 cannot be conveniently removed from the wall 12. This is because the inner wall form assemblies 10 are in tight contact with the inner wall surface of the wall 12 and are restricted within the room confined by the wall 12. In addition, each inner wall form assembly 10 is clamped between two of the four corners of the wall 12. If the outer wall surface of the wall 12 is formed with two vertical posts 13, the form panel 14 between the vertical posts 13 is clamped tightly between the vertical posts 13 and cannot be conveniently removed from the wall 12.

SUMMARY OF THE INVENTION

Therefore, the object of the present invention is to provide a modular wall form assembly which can overcome the aforementioned drawback that is commonly associated with the prior art.

More specifically, the object of the present invention is to provide a modular wall form assembly which can be easily removed after a concrete wall has been formed.

Accordingly, the modular wall form assembly of the present invention comprises two upright wall form panels, a bridging plate interposed removably between the wall form panels, and a plurality of coupling devices for connecting securely the wall form panels and the bridging plate. Each of the coupling devices includes:

at least three horizontally aligned coupling seats mounted respectively on rear sides of the wall form panels and the bridging plate, each of the coupling seats being formed with a rectangular hole and a notch that is located on a longer side of the rectangular hole and that extends to the rectangular hole, the notch having a width shorter than length of the longer side of the rectangular hole; and a T-shaped coupling lever having a handle portion and a coupling portion that extends transversely from one end of the handle portion, the coupling portion having a generally rectangular cross section and corresponding in size with the rectangular holes of the coupling seats.

After the coupling portion has been extended partially into the rectangular holes of the coupling seats via the notches of the coupling seats, the coupling lever can be rotated so that the coupling portion extends fully into the rectangular holes to interconnect removably the wall form panels and the bridging plate.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 2:
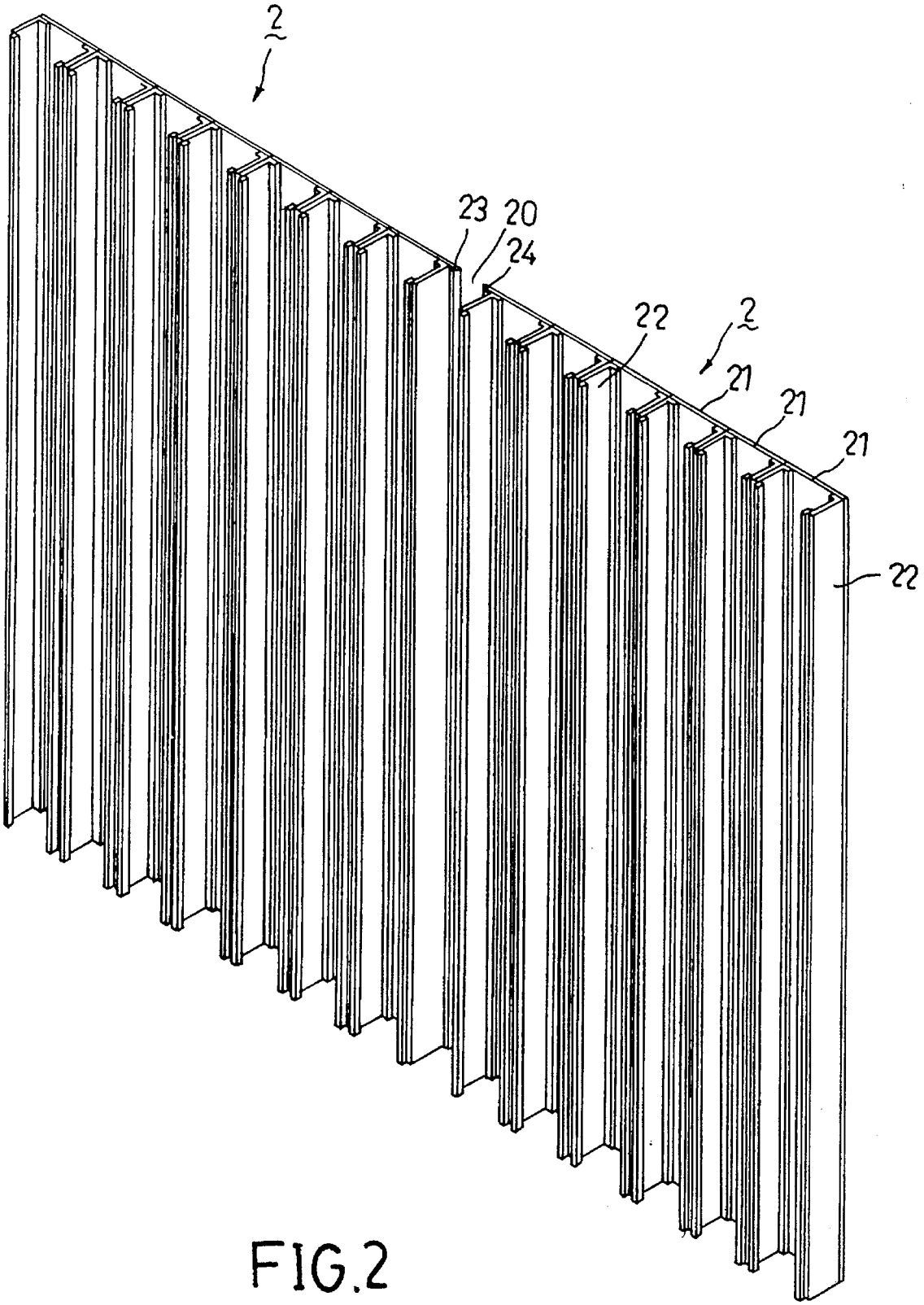
FIG. 2 is a rear perspective view of two upright wall form panels of the preferred embodiment of a modular wall form assembly according to the present invention.

Referring to FIG. 2, an upright wall form panel 2 of the preferred embodiment of a modular wall form assembly according to the present invention is shown to comprise a plurality of parallel elongated units that are arranged side-by-side so that adjacent elongated units can be interconnected. Each elongated unit includes a face plate 21 having a predetermined length and width, and a pair of vertical ribs 22 that are welded to a rear side of the face plate 21 at opposite edges of the latter. The vertical ribs 22 may be formed with aligned holes (not shown) such that a screw fastener (not shown) can extend through juxtaposed vertical ribs 22 of an adjacent pair of the elongated units in order to interconnect the same. After the elongated units have been assembled, the desired width of the wall form panel 2 that is required for the intended application may be obtained.

In the preferred embodiment, adjacent wall form panels 2 are arranged so that distal vertical end units 23, 24 of the same form a clearance 20 therebetween.

Figure 3:
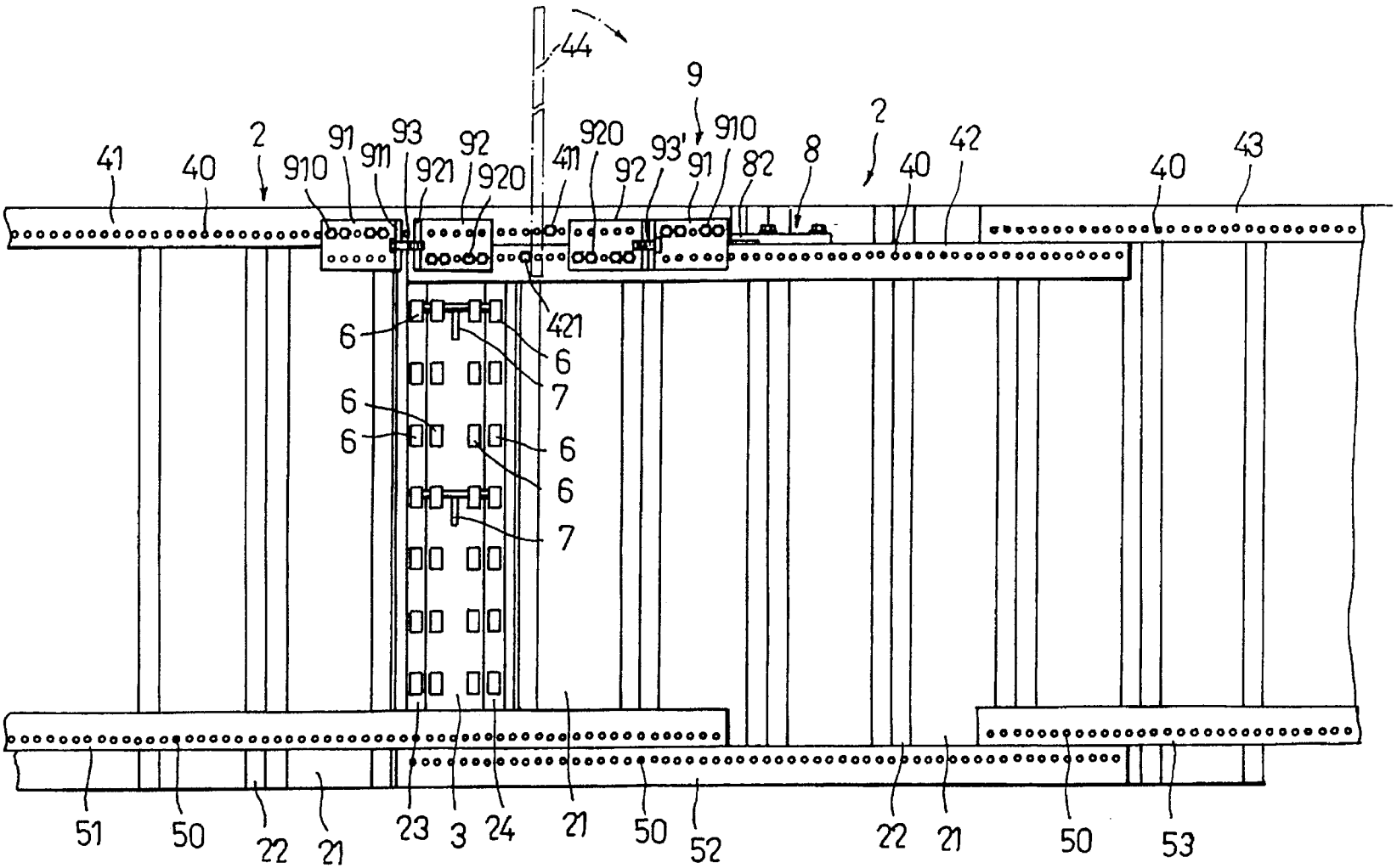
FIG. 3 is a rear view illustrating how adjacent wall form panels of the preferred embodiment are interconnected.
Figure 4:
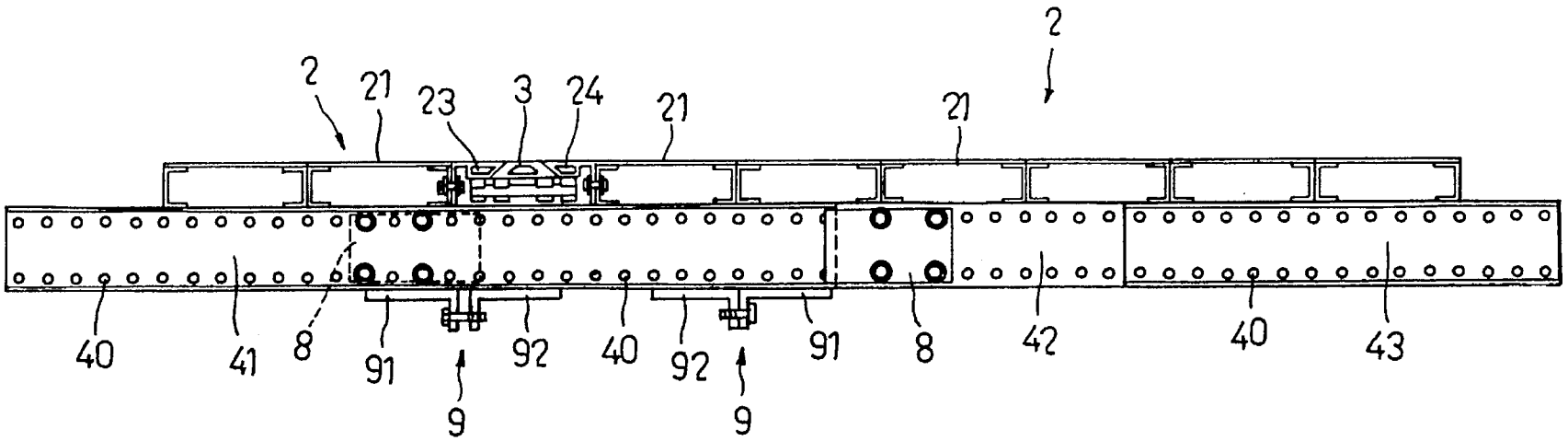
FIG. 4 is a top view illustrating the connection between adjacent wall form panels of the preferred embodiment.

Referring to FIGS. 3 and 4, an elongated bridging plate 3 is disposed between the vertical end units 23, 24 of the adjacent wall form panels 2. A plurality of horizontal reinforcing bars 41, 42, 43, 51, 52, 53 are mounted on the top and bottom ends of the adjacent wall form panels 2.

Figure 5:
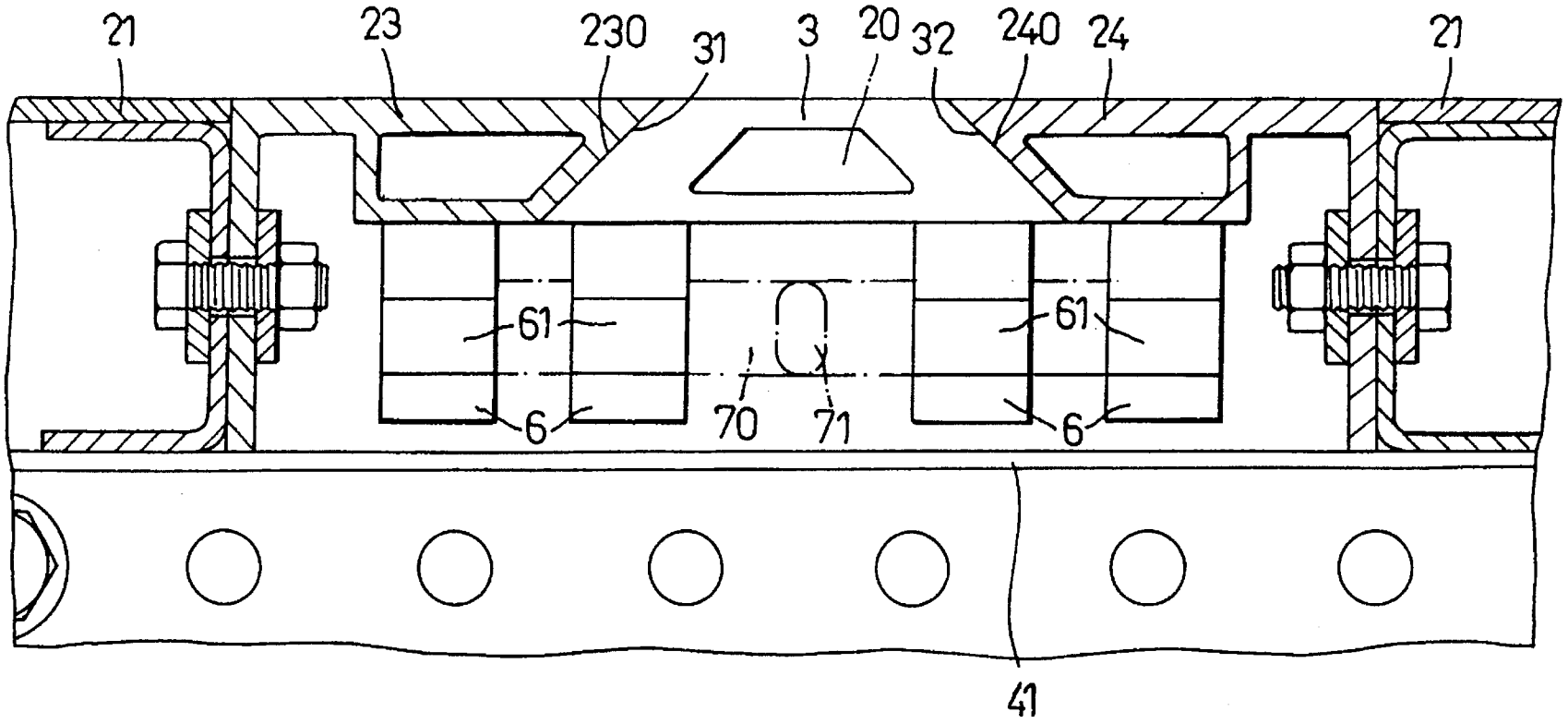
FIG. 5 is an enlarged top view illustrating how a bridging plate interconnects adjacent wall form panels of the preferred embodiment.

Referring to FIG. 5, the vertical ends units 23, 24 of the adjacent wall form panels 2 have inclined end faces 230, 240. The bridging plate 3, which has a trapezoidal cross section, is formed with inclined end faces 31, 32 that complement the end faces 230, 240 of the vertical end units 23, 24 and that abut with the same. The length of the bridging plate 3 is the same as that of the wall form panels 2, and the bridging plate 3 fills up tightly the clearance 20 between the adjacent wall form panels 2.

Figure 6:
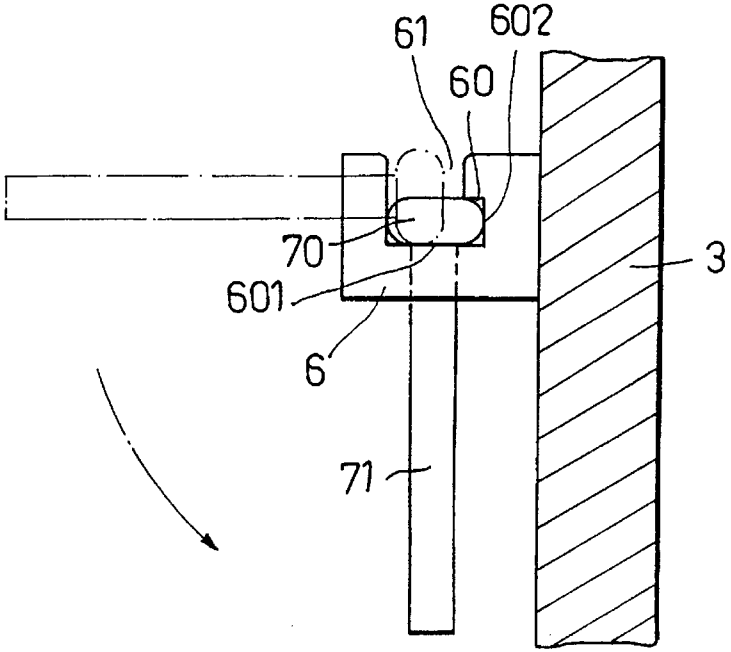
FIG. 6 is a side view which illustrates a coupling device for connecting securely the bridging plate and adjacent wall form panels of the preferred embodiment.

Coupling devices are employed to connect securely the adjacent wall form panels 2 and the bridging plate 3. Each coupling device includes at least three horizontally aligned coupling seat 6 mounted respectively on the rear sides of the vertical end units 23, 24 and the bridging plate 3. As shown in FIG. 6, each coupling seat 6 is formed with a rectangular hole 60 that has a pair of longer sides 601 and a pair of shorter sides 602. Each coupling seat 6 further has a top side formed with a notch 61 that is located on one of the longer sides 601 and that extends to the rectangular hole 60 to permit access into the latter. The width of the notch 61 is shorter than the length of the longer sides 601 of the rectangular hole 60.

Figure 7:
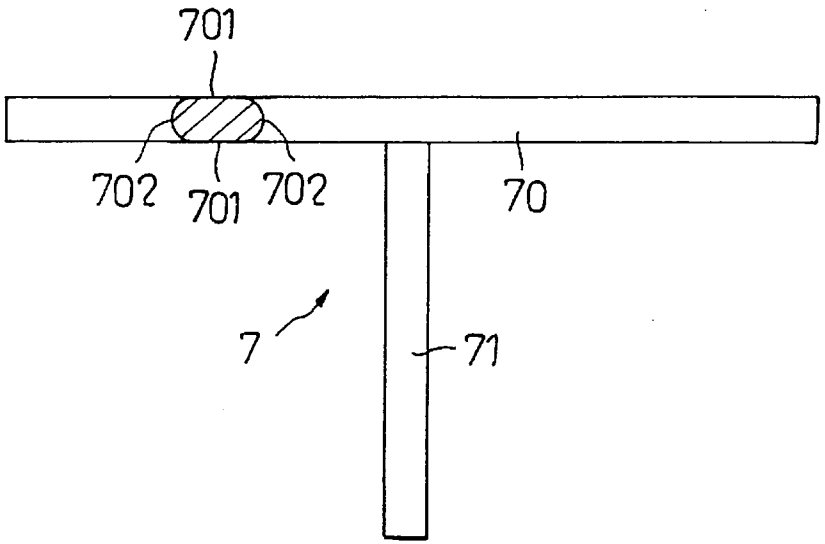
FIG. 7 is a front view which illustrates a coupling lever of the coupling device shown in FIG. 6.

Referring to FIG. 7, each coupling device further includes a T-shaped coupling lever 7. The coupling lever 7 has a handle portion 71 and a coupling portion 70 that extends transversely from one end of the handle portion 71. The length of the coupling portion 70 must be sufficient so as to extend across the coupling seats 6 of the coupling device. The coupling portion 70, which has a generally rectangular cross section, is formed with a pair of longer sides 701 and a pair of shorter sides 702, and corresponds in size with the rectangular holes 60 of the coupling seats 6.

When the coupling device is used to connect securely and removably the bridging plate 3 and the adjacent wall form panels 2, the coupling lever 7 is initially disposed in a horizontal position so that the shorter sides 702 of the coupling portion 70 are parallel with the longer sides 601 of the rectangular holes 60 to permit partial extension of the coupling portion 70 into the rectangular holes 60 via the notches 61. The coupling lever 7 is then turned downwardly by a 90° angle so that the longer sides 701 of the coupling portion 70 are parallel with the longer sides 601 of the rectangular holes 60 to result in full extension of the coupling portion 70 into the rectangular holes 60. The longer sides 701 of the coupling portion 70 abut firmly with the longer sides 601 of the rectangular holes 60 at this time to connect securely the bridging plate 3 and the adjacent wall form units 2.

It is noted that when the coupling lever 7 is disposed in the horizontal position, the coupling lever 7 can be easily removed from the coupling seats 6 to permit removal of the bridging plate 3 from the vertical end units 23, 24 of the wall form panels 2, thus forming the clearance 20 between the wall form panels 2. In this embodiment, there are four coupling seats 6 which engage the coupling portion 70 of the coupling lever 7, one on each of the vertical end units 23, 24 and two on the bridging plate 3. This number may be smaller or bigger, depending upon the dimensions of the wall form panels 2. It is also noted that, when a larger number of coupling devices is used to connect securely the bridging plate 3 to the adjacent wall form panels 2, the wall form panels 2 are provided with a greater strength for bearing the pressure that is applied by concrete on one side thereof while the wall form assembly of this invention is in use.

Referring once more to FIGS. 4 and 5, each of the reinforcing bars 41, 42, 43, 51, 52, 53 is formed as a U-shaped bar with an appropriate length. The flat faces of each reinforcing bar 41, 42, 43, 51, 52, 53 are respectively formed with a row of through-holes 40, 50 that permit extension of a screw fastener (not shown) therethrough. The reinforcing bars 41, 42, 43, 51, 52, 53 are mounted horizontally on the vertical ribs 22 of the elongated units of the adjacent wall form panels 2 by means of screws and the like and serve to reinforce the wall form panels 2. Adjacent ones of the reinforcing bars, 41, 42, 43, 51, 52, 53, have overlapping end portions that form an H-shaped structure (not shown). Screw fasteners (not shown) extend through the overlapping end portions of some of the adjacent reinforcing bars 42, 43, 52, 53 to interconnect securely the latter.

Figure 8:
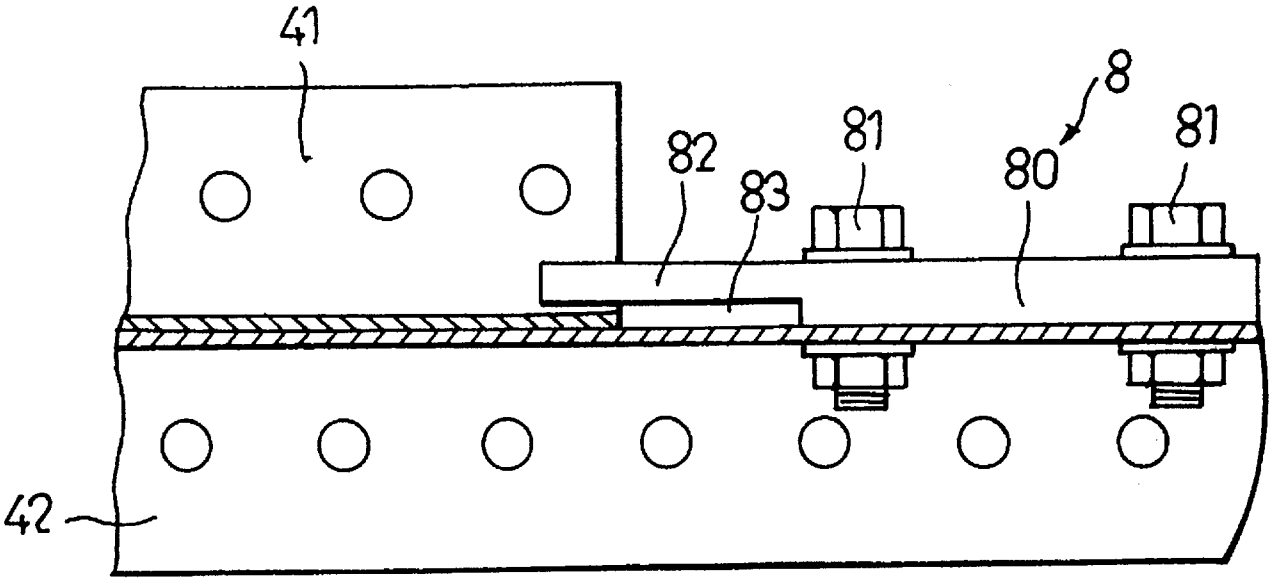
FIG. 8 is an enlarged front view of a pressing device of the preferred embodiment.

Note that relative lateral movement of the reinforcing bars 41, 42, 51, 52 which are immediately behind the bridging plate 3 must be permissible. Referring to FIG. 8, a pressing device 8 is installed at the overlapping end portions of some of the adjacent reinforcing bars, such as 41, 42. The pressing device 8 includes a rectangular mounting plate 80 which is secured on the back side of the reinforcing bar 42 by means of screw fasteners 81. The mounting plate 80 has a front end which is formed with a thin press portion 82 that extends toward the reinforcing bar 41 and that forms a clearance 83 with the back side of the reinforcing bar 42. The reinforcing bar 41 extends into the clearance 83. The press portion 82 permits lateral movement of the reinforcing bar 41 but guards against vertical movement of the same. Thus, the pressing device 8 is preferably installed at the overlapping end portions of the adjacent reinforcing bars 41, 42, 51, 52 which are immediately behind the bridging plate 3.

Referring once more to FIGS. 3 and 4, at least one positioning device 9 can be installed at the overlapping end portions of the adjacent reinforcing bars 41, 42, 51, 52 which are immediately behind the bridging plate 3. Each positioning device 9 includes a pair of positioning plates 91, 92 which are disposed on one side of the overlapping end portions of the adjacent reinforcing bars 41, 42 or 51, 52. Screws 910, 920 mount the positioning plates 91, 92 on the reinforcing bars 41, 42, respectively. The positioning plates 91, 92 have adjacent ends formed with a respective rearward flange portion 911, 921. The flange portion 911 is formed with a through-hole, while the flange portion 921 is formed with a threaded hole that is aligned with the through-hole in the flange portion 911. A screw 93, 93' extends through the through-hole and the threaded hole in the flange portions 911, 921.

After the bridging plate 3 has been removed and the screw 93' has been loosened, tightening of the screw 93 results in movement of the positioning plates 91, 92 toward each other. This causes corresponding movement of the reinforcing bars 41, 42 and the adjacent wall form panels 2 toward one another to contract the wall form assembly of this invention. Accordingly, if the screw 93 is loosened and the screw 93' is tightened, the adjacent wall form panels 2 move away from each other to expand the wall form assembly of this invention.

Since the positioning devices 9 are installed on the reinforcing bars 41, 42, 51, 52, which are mounted on the top and bottom ends of the adjacent wall form panels 2, proper movement of the adjacent wall form panels 2 is ensured when the positioning devices 9 are operated. In addition, the positioning devices 9 serve to further strengthen the connection among the adjacent reinforcing bars 41, 42, or 51, 52.

If the positioning devices 9 are not in use, two bolts 411, 421 may be mounted respectively on one side of the overlapping end portions of the adjacent reinforcing bars 41, 42. A crowbar 44 is then extended between the bolts 411, 421 and is pivoted to force relative movement between the reinforcing bars 41, 42 and move correspondingly the adjacent wall form panels 2 in order to contract or expand the wall form assembly of this invention.

Figure 1:
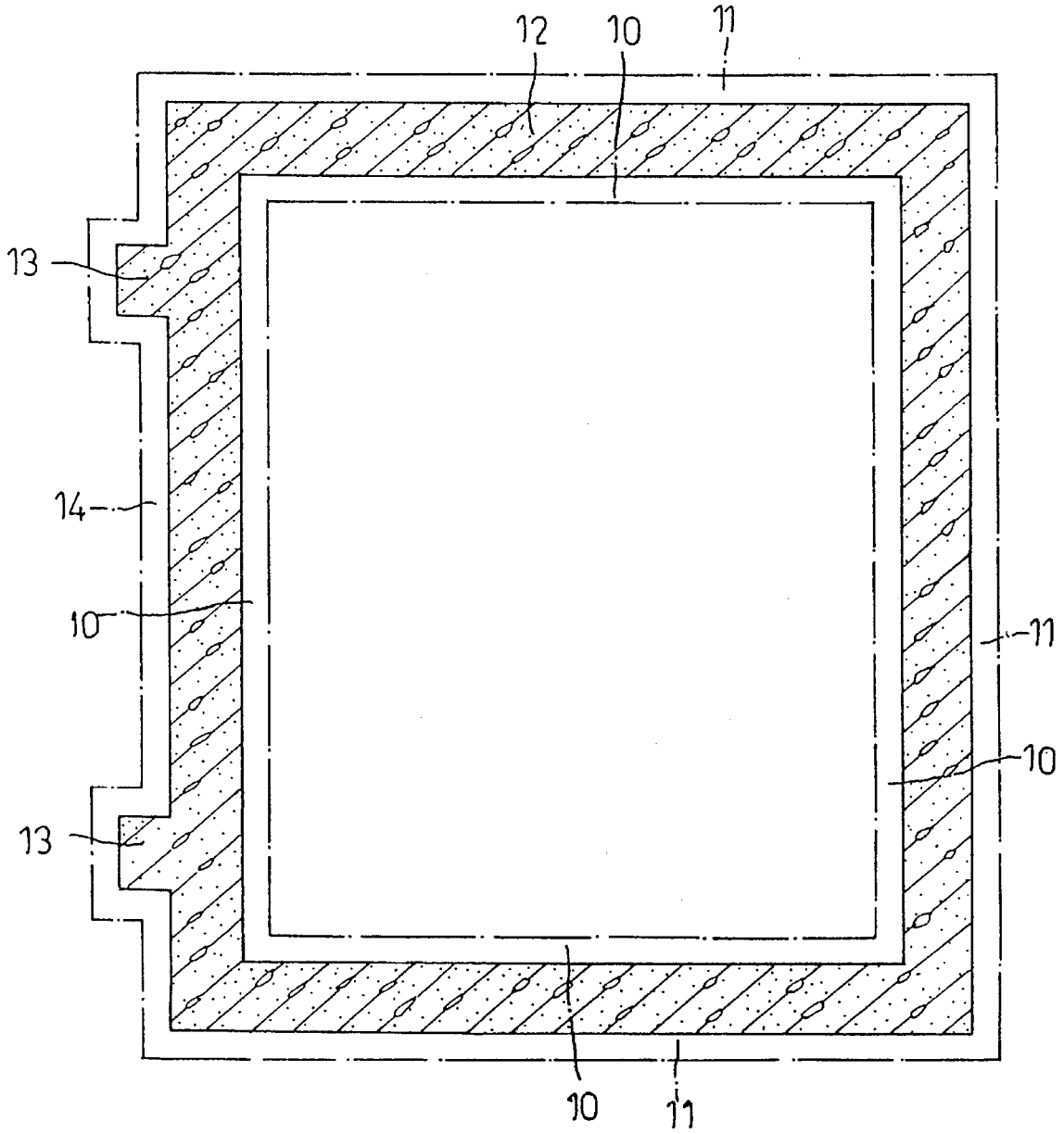
FIG. 1 PRIOR ART
FIG. 1 is a top view which illustrates how a concrete wall is conventionally formed with the use of wall form assemblies.

When the preferred embodiment is used in the construction of a concrete wall, the positioning devices 9 or the crowbar 44 are operated to move apart adjacent wall form panels 2 and form the clearance 20 therebetween. The bridging plate 3 is then inserted in the clearance 20, and the coupling levers 7 of the coupling devices are installed on the coupling seats 6 to interconnect securely the adjacent wall form panels 2 and the bridging plate 3. Once assembled, the wall form assembly can be used with other wall form assemblies to confine a pouring space for a concrete wall similar to that shown in FIG. 1.

After the concrete wall has been constructed, the coupling levers 7 are removed from the coupling seats 6, and the bridging plate 3 is removed from the vertical end units 23, 24 of the adjacent wall form panels 2. The positioning devices 9 or the crowbar 44 are then operated to move the adjacent wall form panels 2 toward one another so as to contract the wall form assembly of this invention. At this time, the wall form assembly ceases to be clamped at two ends by the concrete wall and thus, removal of the wall form assembly can be achieved with ease.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A modular wall form assembly comprising:

two upright wall form panels;

a bridging plate interposed removably between said wall form panels, each of said wall form panels and said bridging plate having a rear side;

a plurality of coupling devices provided on said rear sides of said wall form panels and said bridging plate of connecting securely said wall form panels and said bridging plate;

horizontal first and second reinforcing bars, each of which is mounted on said rear side of a respective one of said wall form panels, said first and second reinforcing bars having overlapping end portions; and first and second positioning devices, each of which includes:

first and second positioning plates, each of which is mounted on a respective one of said first and second reinforcing bars at one side of said overlapping end portions of said reinforcing bars, said first and second positioning plates having adjacent ends formed with a respective rearward flange portion, said flange portion of said first positioning plate being formed with a through-hole, said flange portion of said second positioning plate being formed with a threaded hole that is aligned with said through-hole; and a screw extending through said through-hole and said threaded hole in said flange portions of said first and second positioning plates;

said second position plates of said positioning devices being disposed between said first positioning plates of said positioning devices;

whereby, loosening of said screw of one of said first and second positioning devices and tightening of said screw of the other one of said first and second positioning devices result in relative movement between said wall form panels.

2. The modular wall form assembly as claimed in claim 1, wherein said bridging plate has a trapezoidal cross section and is formed with inclined end faces which abut against said wall form panels.

3. The modular wall form assembly as claimed in claim 1, wherein each of said coupling devices includes:

at least three horizontally aligned coupling seats mounted respectively on said rear sides of said wall form panels and said bridging plate, each of said coupling seats being formed with a rectangular hole and a notch that is located on a longer side of said rectangular hole and that extends to said rectangular hole, said notch having a width shorter than length of said longer side of said rectangular hole; and a T-shaped coupling lever having a handle portion and a coupling portion that extends transversely from one end of said handle portion, said coupling portion having a generally rectangular cross section and corresponding in size with said rectangular holes of said coupling seats;

whereby, after said coupling portion has been extended partially into said rectangular holes of said coupling seats via said notches of said coupling seats, said coupling lever can be rotated so that said coupling portion extends fully into said rectangular holes to interconnect removably said wall form panels and said bridging plate.

4. The modular wall form assembly as claimed in claim 1, further comprising a pressing device which includes a mounting plate secured on one of said reinforcing bars, said mounting plate having a front end formed with a press portion that extends toward an adjacent one of said reinforcing bars and that forms a clearance with said one of said reinforcing bars, said adjacent one of said reinforcing bars extending into said clearance;

whereby, said pressing device permits lateral movement but guards against vertical movement of said adjacent one of said reinforcing bars.

* * * * *